US006761246B2

(12) United States Patent
Bowles

(10) Patent No.: US 6,761,246 B2
(45) Date of Patent: Jul. 13, 2004

(54) METHODS AND APPARATUS FOR MOUNTING A WORK PLATFORM TO A LADDER

(76) Inventor: Dennis I. Bowles, H.C.R. 87, Box 5205, Potosi, MO (US) 63664

( * ) Notice: Subject to any disclaimer, the term of this patent is extended or adjusted under 35 U.S.C. 154(b) by 0 days.

(21) Appl. No.: 09/916,809

(22) Filed: Jul. 27, 2001

(65) Prior Publication Data

US 2002/0043427 A1 Apr. 18, 2002

Related U.S. Application Data

(63) Continuation-in-part of application No. 09/361,840, filed on Jul. 27, 1999, now Pat. No. 6,286,624.

(51) Int. Cl.[7] ..... E06C 7/16
(52) U.S. Cl. ..... 182/117; 182/121
(58) Field of Search ..... 182/117, 121–123, 182/118

(56) References Cited

U.S. PATENT DOCUMENTS

| | | | | | |
|---|---|---|---|---|---|
| 328,999 | A | | 10/1885 | Ballmann | |
| 510,194 | A | * | 12/1893 | Sellers | 248/236 |
| 1,423,998 | A | * | 7/1922 | Camp | 182/150 |
| 2,485,685 | A | | 10/1949 | Armstrong | |
| 4,179,011 | A | | 12/1979 | Morawski | |
| 5,139,108 | A | * | 8/1992 | Pate | 182/108 |
| 5,624,006 | A | * | 4/1997 | Richardson | 182/45 |
| 6,109,391 | A | * | 8/2000 | Tyson | 182/117 |

FOREIGN PATENT DOCUMENTS

| | | | | |
|---|---|---|---|---|
| GB | 1363224 A | * | 8/1974 | E06C/7/16 |
| GB | 2 194 983 A | | 3/1988 | |
| GB | 2194983 A | * | 3/1988 | E06C/7/16 |
| JP | 06280383 A | | 10/1994 | |
| JP | 6280383 | * | 10/1994 | 182/117 |

* cited by examiner

*Primary Examiner*—Alvin Chin-Shue
(74) *Attorney, Agent, or Firm*—Armstrong Teasdale LLP

(57) ABSTRACT

A mounting system mounts a work platform to a ladder that includes a plurality of rungs, such that the work platform is elevated a distance above the ground. The mounting system includes a support system, a rod, and a suspension mount. The support system includes a plurality of members, wherein the members include at least a first member and a second member. The first member is mounted substantially perpendicularly to the second member and includes a first end and a second end. The first member first and second ends include a plurality of first openings that extend therethrough. The second member is configured to attach to the work platform, and includes a first end and a second end. The second member first and second ends include a plurality of second openings that extend therethrough. The support system is configured to attach to the ladder. The rod is configured to secure the support system to the ladder, and is further configured to extend through one of the ladder rungs. The suspension mount is attached to the support system, and is configured to attach to a ladder rung.

7 Claims, 10 Drawing Sheets

METHODS AND APPARATUS FOR MOUNTING A WORK PLATFORM TO A LADDER

CROSS REFERENCE TO RELATED APPLICATIONS

This application is a continuation-in-part of U.S. patent application Ser. No. 09/361,840 filed Jul. 27, 1999 now U.S. Pat. No. 6,286,624.

BACKGROUND OF THE INVENTION

This invention relates generally to mounting systems and, more particularly, to mounting systems for mounting a work platform to a ladder.

When performing work around a building, it is often desirable to use a scaffold or an extension ladder to work on areas of the building that are elevated from the ground. However, most scaffolds are relatively complex structures which are relatively expensive, difficult to move, and difficult to assemble. Furthermore, extension ladders do not provide a large work platform, are awkward to work from, and must be moved frequently if the work area is large. Additionally, it is often difficult to make the scaffold or the extension ladder stand steady, particularly when the ground adjacent the building is uneven.

As a result, combination ladder and scaffold systems are used. Combination systems typically include two ladders which each support one end of a board or work platform. Typically, the work platform merely rests on the rungs of the two ladders, and is subject to slipping from the rungs. Such systems are intrinsically unsafe, provide work platforms that are awkward to work from, and are unreliable.

BRIEF SUMMARY OF THE INVENTION

In one aspect of the invention, a mounting system is provided for mounting a work platform to a ladder that includes a plurality of rungs, such that the work platform is elevated a distance above the ground. The mounting system includes a support system, a rod, and a suspension mount. The support system includes a plurality of members, wherein the members include at least a first member and a second member. The first member is mounted substantially perpendicularly to the second member and includes a first end and a second end. The first member first and second ends include a plurality of first openings that extend therethrough. The second member is configured to attach to the work platform, and includes a first end and a second end. The second member first and second ends include a plurality of second openings that extend therethrough. The support system is configured to attach to the ladder. The rod is configured to secure the support system to the ladder, and is further configured to extend through one of the ladder rungs. The suspension mount is attached to the support system, and is configured to attach to a ladder rung.

In another aspect, a mounting system is provided for mounting a work platform to a ladder that includes at least a first rung, a second rung, and a third rung. The mounting system includes a support system, a rod, and a suspension mount. The support system includes a plurality of members. At least a first of the plurality of members includes a first end and a second end. The first member is positionable along its length between the first and second ends. At least a second of the plurality of members is configured to extend between the first member and the ladder first rung such that the second member is substantially perpendicular to the first member. The rod is configured to secure the support system to the ladder, and is further configured to extend through one of the rungs. The suspension mount is attached to the support system and is configured to attach to the ladder rung.

In operation, in one embodiment, the suspension mount is attached to the ladder rung with a hook assembly. The support system includes a first member that is suspended generally perpendicularly to the ground from the hook assembly. A second member is mounted substantially perpendicularly to the first member and is easily adjustable. A third member extends generally perpendicularly from the second member towards an upright rail on the ladder. A fourth member extends generally perpendicularly from the second member towards the opposite upright ladder rail. A rod is extended through the third member, the ladder rung, and the fourth member. As a result, the mounting system eliminates more costly and more complicated known work platform positioning systems and provides a mounting system that is highly reliable, cost-effective, and easily assembled.

DETAILED DESCRIPTION OF THE INVENTION

Figure 1:
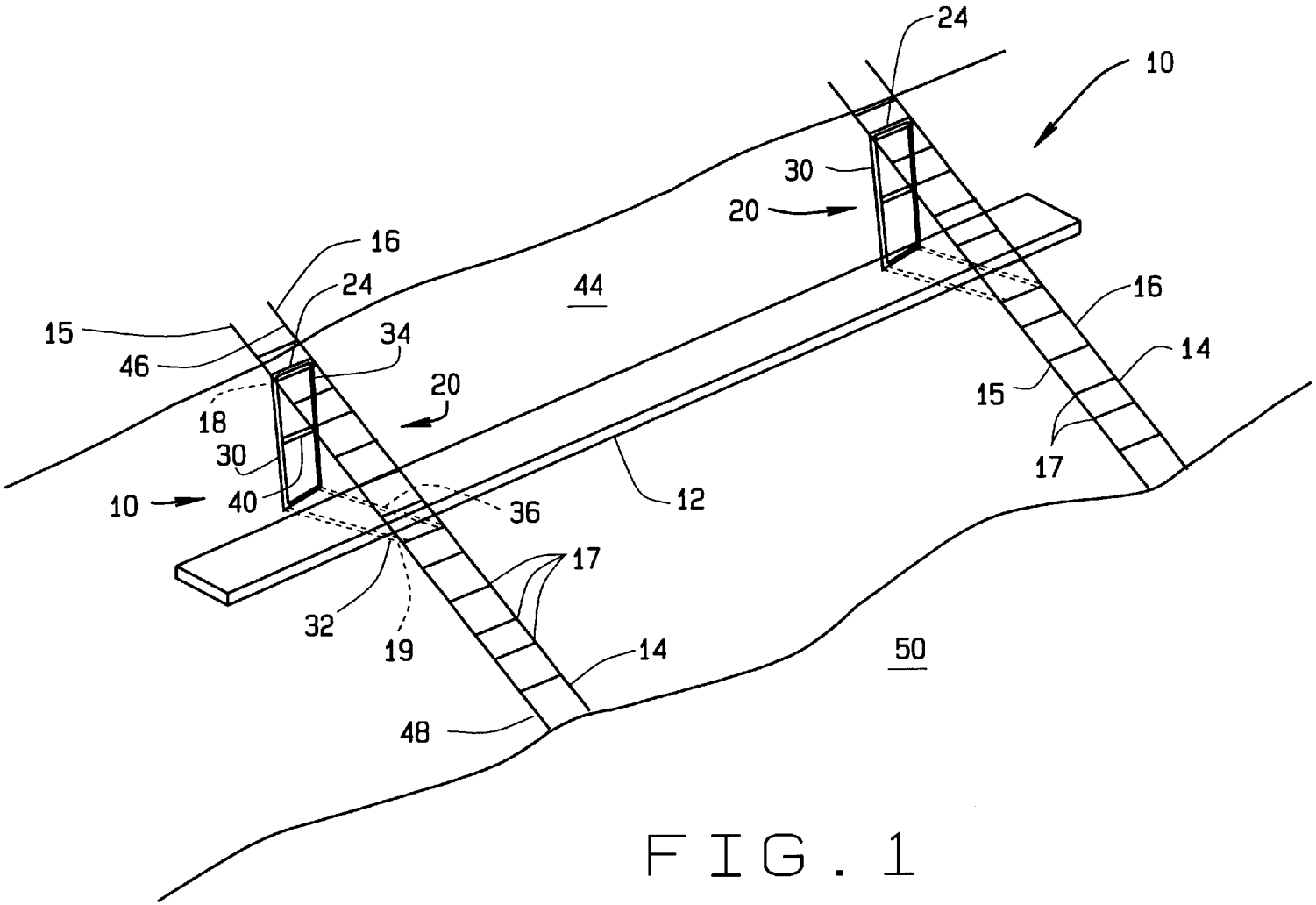
FIG. 1 is a perspective view of a mounting system for mounting a work platform to a ladder in accordance with one embodiment of the present invention.

FIG. 1 is a perspective view of a mounting system 10 for mounting a work platform 12 to a ladder 14. Ladder 14 can be a straight ladder or an extension ladder and includes a pair of upright supports 15 and 16, and a plurality of hollow rungs 17. Hollow rungs 17 include a first rung 18 and a second rung 19. Mounting system 10 includes a support system 20 to attach to ladder 14, a rod (not shown in FIG. 1) to secure support system 20 to ladder 14, and a suspension mount 24 to attach support system 20 to ladder rung 18. Support system 20 includes a first member 30, a second member 32, a third member 34, and a fourth member 36. First member 30 is mounted substantially perpendicularly to second member 32 and third member 34 is mounted substantially perpendicularly to fourth member 36. First member 30 is substantially parallel to third member 34 and second member 32 is substantially parallel to fourth member 36. A fifth member 40 is attached between first member 30 and third member 34 such that fifth member 40 is substantially perpendicular to first member 30 and third member 34.

In operation, ladder 14 is leaned in position against a structure 44. Ladder 14 has a first end 46 and a second end 48. In operation, first end 46 is elevated above a floor 50 and is in close proximity with structure 44 while second end 48 remains in contact with floor 50. Mounting system 10 is attached to ladder 14 with support system 20. Support system suspension mount 24 is attached to ladder rung 18 so that when first member 30 and third member 34 are attached, first member 30 and third member 34 are suspended from first rung 18 generally perpendicularly towards floor 50. Second member 32 and fourth member 36 are attached to second rung 19 such that second member 32 extends generally perpendicularly from first member 30 to ladder 14 and fourth member 36 extends generally perpendicularly from third member 34 to ladder 14. Furthermore, when mounting system 10 is attached, second member 32 and fourth member 36 are generally parallel to floor 50. As such, when work platform 12 is attached to mounting system 10, work platform 12 is generally parallel to floor 50.

Figure 2:
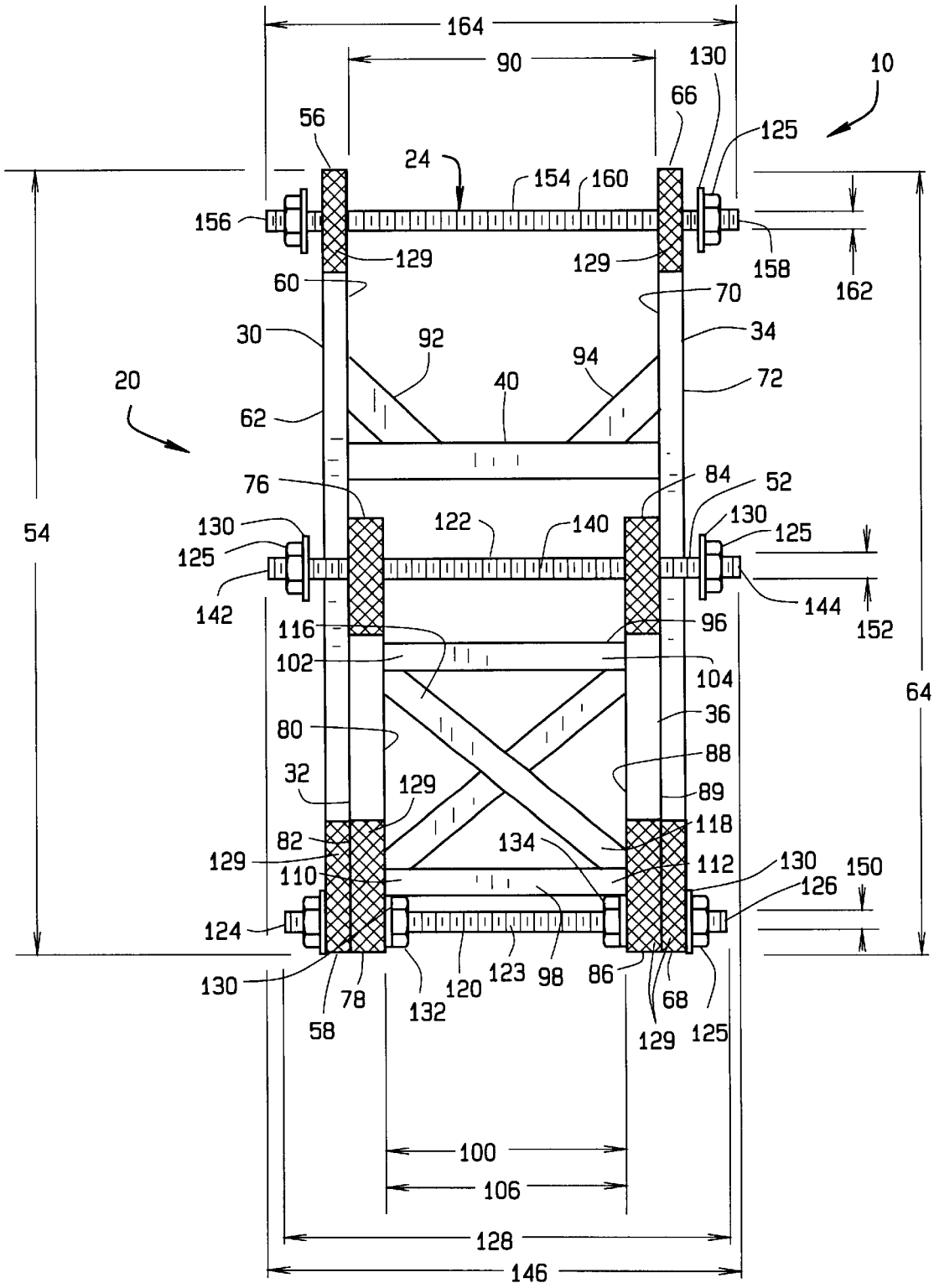
FIG. 2 is a front elevational view of the mounting system shown in FIG. 1 in a stored position.

FIG. 2 is a front elevational view of mounting system 10 shown in a stored position 52. First member 30 of mounting system 10 has a length 54 and includes a first end 56, a second end 58 attached to second member 32, an inner surface 60, and an outer surface 62. Third member 34 has a length 64 and includes a first end 66, a second end 68 attached to fourth member 36, an inner surface 70, and an outer surface 72. In one embodiment, length 54 is substantially equal to length 64 and is approximately 60 inches. Second member 32 has a first end 76 attached to first member 30, a second end 78, an inner surface 80, and an outer surface 82. Fourth member 36 includes a first end 84 attached to third member 34, a second end 86, an inner surface 88, and an outer surface 89. In one embodiment, first member 30, second member 32, third member 34 and fourth member 36 have rectangular cross-sectional profiles. In another embodiment first member 30, second member 32, third member 34 and fourth member 36 are constructed from wood. In another embodiment first member 30, second member 32, third member 34 and fourth member 36 are constructed from plastic. In yet another embodiment, first member 30, second member 32, third member 34 and fourth member 36 are constructed from a metal, such as aluminum or steel.

Fifth member 40 extends between first member 30 and third member 34 to provide additional support to first member 30 and third member 34. Fifth member 40 has a length 90 and includes a pair of angled braces 92 and 94. In one embodiment, length 90 is approximately 21⅜ inches. Brace 92 is attached between fifth member 40 and first member 30. Brace 94 extends between fifth member 40 and third member 34.

A pair of braces 96 and 98 are attached between second member 32 and fourth member 36. Braces 96 and 98 are mounted generally perpendicularly to second member 32 and fourth member 36 to provide additional structural support to mounting system 10. Brace 96 has a length 100 and includes a first end 102 attached to second member 32 and a second end 104 attached to fourth member 36. Brace 98 has a length 106 and includes a first end 110 attached to second member 32 and a second end 112 attached to fourth member 36. In one embodiment, length 100 is substantially equal to length 106 and is approximately 18 inches. A pair of cross braces 116 and 118 extend between second member 32 and fourth member 36 and between brace 96 and brace 98 respectively. Cross brace 116 extends from first end 102 of brace 96 to second end 112 of brace 98. Cross brace 118 extends from first end 110 of brace 98 to second end 104 of brace 96.

Mounting system 10 includes a first rod 120 and a second rod 122. First rod 120 includes threads 123 sized to receive nuts 125 and has a first end 124 positioned in close proximity to first member second end 58, a second end 126 positioned in close proximity to third member second end 68. In one embodiment, rod 120 only includes threads 123 in close proximity to each respective rod end 124 and 126, and as such, threads 123 do not extend between members 32 and 36. First rod 120 also has a length 128. In one embodiment length 128 is approximately 27 inches. In another embodiment, first rod 120 does not include any threads 123 and rather, a threaded rod (not shown) is extended through a cylindrical sleeve. In a further embodiment, rods 120 and 122 do not include any external threads 123, but rather, rods 120 and 122 are hollow and are threaded on their internal surfaces (not shown). As such, nuts 125 are not used to secure rods 120 and 122 in place, but rather threaded bolts (not shown) are tightened into rods 120 and 122 to secure rods 120 and 122 in place.

The threaded rod has a length (not shown) that is longer than first rod length 128, and as such, nuts 125 secure rod 120 in position while members 32 and 36 are pivotally coupled to rod 120.

First, second, third, and fourth member ends 56 and 58, 76 and 78, 66 and 68, 84 and 86, respectively are reinforced with a reinforcing member 129. In the exemplary embodiment, each respective member end 56, 58, 76, 78, 66, 68, 84, and 86 is inserted within a reinforcing member 129 such that reinforcing member 129 substantially surrounds each end 56, 58, 76, 78, 66, 68, 84, and 86. In an alternative embodiment, each reinforcing member 129 is wrapped around each respective member end 56, 58, 76, 78, 66, 68, 84, and 86. In the exemplary embodiment, each reinforcing member is fabricated from a metallic material. In alternative embodiments, each reinforcing member is fabricated from a material that provides support to each member 30, 32, 34, and 36, and facilitates reducing wear to each respective member end 56 and 58, 76 and 78, 66 and 68, 84 and 86, such as, but not limited to carbon graphite or ceramic.

In operation, rod 120 is inserted through first member 30, second member 32, a washer 130, a first retainer nut 132, a second retainer nut 134, another washer 130, fourth member 36, and third member 34. Rod length 128 is such when rod 120 is fully inserted, rod first end 124 extends beyond first member outer surface 62 and rod second end 126 extends beyond third member outer surface 72. Washers 130 are inserted on rod first end 124 and rod second end 126. Nut 125 is tightened on rod first end 124 against washer 130 which is positioned adjacent first member outer surface 62. Another nut 125 is tightened on rod second end 126 against washer 130 which is positioned adjacent third member outer surface 72. In an alternative embodiment, a pair of threaded bar bell clamps are used in place of nuts 125, and provide the advantage of including quick release handles that enable the clamps to be quickly loosened and/or tightened without the use of tools.

Retainer nut 132 is tightened against washer 130 which is adjacent second member inner surface 80. Retainer nut 134 is tightened against washer 130 which is positioned adjacent fourth member inner surface 88. Nuts 125 and retainer nuts 132 and 134 are tightened on rod 120 to create a hinge that enables second member 32 to rotate with respect to first member 30 and fourth member 36 to rotate with respect to third member 34. Braces 96 and 98 and cross braces 116 and 118 ensure that second member 32 rotates simultaneously with fourth member 36 and that second member 32 remains substantially parallel to fourth member 36. Rod 120 also enables second member 32 and fourth member 36 to be fully rotated to stored position 52 wherein second member 32 and fourth member 36 are positioned adjacent first member 30 and third member 34.

Rod 122 includes threads 140 sized to receive nuts 125, a first end 142 positioned in close proximity to second member first end 74, and a second end 144 positioned in close proximity to fourth member first end 84. Additionally, rod 122 has a length 146. In one embodiment, length 146 is approximately 27 inches. Rods 120 and 122 have diameters 150 and 152 respectively, which are substantially equal. In one embodiment diameters 150 and 152 are approximately 0.5 inches.

Suspension mount 24 includes a rod 154 which has a first end 156 positioned in close proximity to first member first end 56 and a second end 158 positioned in close proximity to third member first end 66. Rod 154 includes threads 160 sized to engage nuts 125. Additionally, rod 154 has a diameter 162 and a length 164. In one embodiment, diameter 162 is approximately 0.5 inches and length 164 is approximately 27 inches. In one embodiment, rod 154 only includes threads 160 in close proximity to each respective rod end 156 and 158, and as such, threads 160 do not extend between members 30 and 34. In a further embodiment, rod 154 does not include any external threads 160, but rather, rod 154 is hollow and is threaded on an internal surface (not shown). As such, nuts 125 are not used to secure rod 154 in place, but rather a threaded bolt (not shown) is tightened into rod 154 to secure rod 154 in place.

In operation, rod 154 is inserted through first member 30, first rung 18, and third member 34. First member inner surface 60 is positioned adjacent ladder upright support 15 and third member inner surface 70 is positioned adjacent upright support 16. Rod length 164 is such that when rod 154 is fully inserted, rod first end 156 extends beyond first member outer surface 62 and rod second end 158 extends beyond third member outer surface 72. Washers 130 are installed on rod first end 156 and rod second end 158. Nut 125 is tightened on rod first end 156 against washer 130 which is positioned adjacent first member outer surface 62. Another nut 125 is tightened on rod second end 158 against washer 130 that is positioned adjacent third member outer surface 72.

After rod 154 is attached to ladder 14 (as described above), second member 32 and fourth member 36 are rotated substantially perpendicularly to first member 30 and third member 34. Rod 122 then attaches mounting system 10 to ladder 14. Rod 122 is inserted through second member 32, ladder rung 19, and fourth member 36. Second member inner surface 80 is positioned adjacent ladder upright support 15 and fourth member inner surface 88 is positioned adjacent upright support 16. Rod length 146 is such that when rod 122 is fully inserted, rod first end 142 extends beyond second member outer surface 82 and rod second end 144 extends beyond fourth member outer surface 89. Washers 130 are installed on rod first end 142 and rod second end 144. Nut 125 is tightened on rod first end 142 against washer 130 which is positioned adjacent second member outer surface 82. Another nut 125 is tightened on rod second end 144 against washer 130 that is positioned adjacent fourth member outer surface 89.

Figure 3:
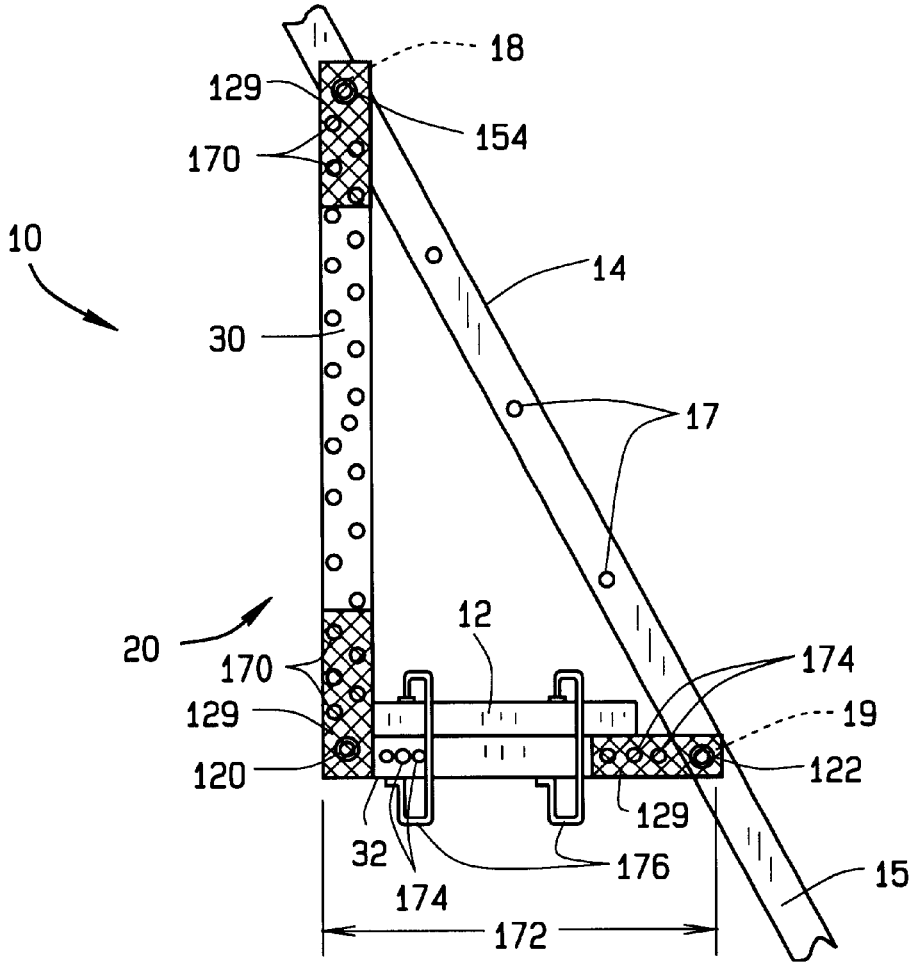
FIG. 3 is a side elevational view of the mounting system shown in FIG. 1 attached to a ladder.

FIG. 3 is a side elevational view of mounting system 10 including ladder 14 which includes hollow ladder rungs 17 and upright support 15. Support system 20 includes first member 30 and second member 32. First member 30 includes a plurality of openings 170 sized to receive suspension mount rod 154. Second member 32 has a length 172 and includes a plurality of openings 174 sized to receive rod 122. In one embodiment, length 172 is approximately 33 inches. In another embodiment, first member 30 and third member 34 (shown in FIG. 2) have a length (not shown) long enough to enable members 30 and 34 to contact the ground, to facilitate additional bracing of mounting system 10. Furthermore, in such an embodiment, a plurality of additional braces (not shown) may couple to additional rungs in a similar manner as described above for second member 32, and extend to members 30 and 34 to facilitate additional bracing of mounting system 10.

In operation, the combination of openings 170 and 174 and the hinge action of rod 120, permits support system 20 to be adjusted such that first member 30 remains suspended from ladder 14 and is substantially perpendicular to the floor (not shown in FIG. 3) while second member 32 is positioned substantially parallel to the floor. As such, when work platform 12 is secured to mounting system 10 with a plurality of fastener assemblies 176, work platform 12 is substantially parallel to the floor. In one embodiment, fastener assemblies 176 are C-clamps. In another embodiment, fastener assemblies 176 are U-bolts. In a further embodiment, tension clamps are used that include adjustable set screws. In another embodiment, ratchet straps are used to secure work platform 12 rather than fastener assemblies 176.

Figure 4:
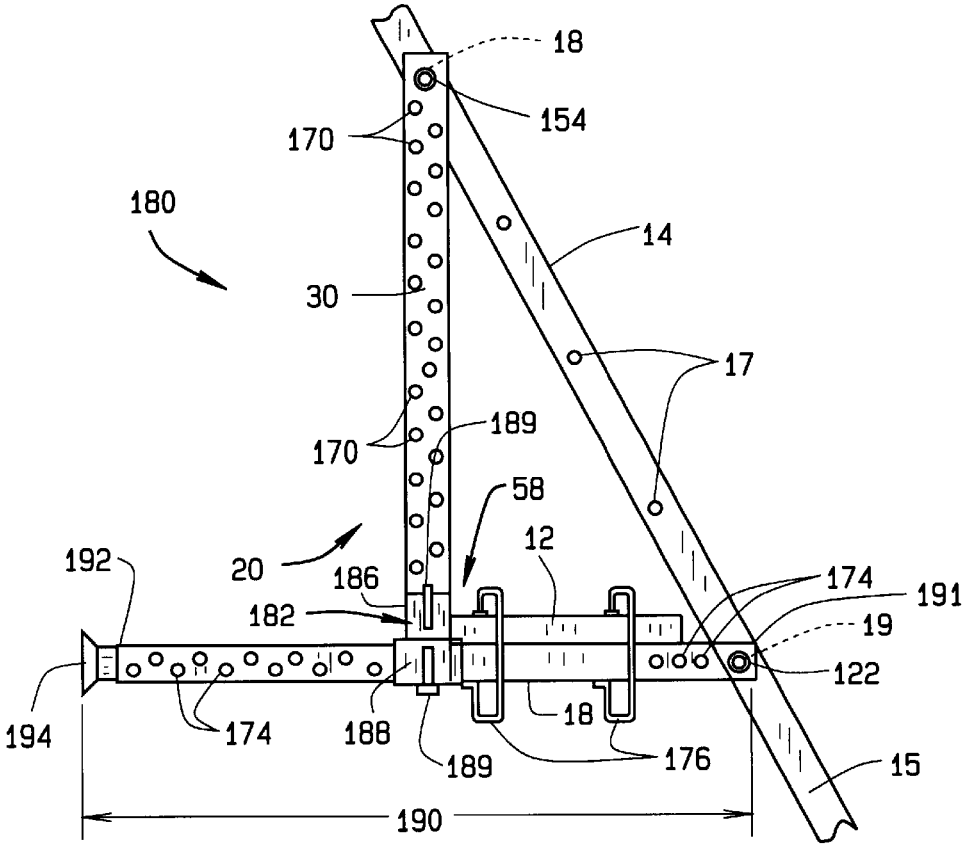
FIG. 4 is a side elevational view of an alternative embodiment of the mounting system shown in FIG. 3.

FIG. 4 is a side elevational view of an alternative embodiment of a mounting system 180. Mounting system 180 is substantially similar to mounting system 10 shown in FIGS. 1, 2, and 3, and components in mounting system 180 that are identical to components of mounting system 10 are identified in FIG. 4 using the same reference numerals used in FIGS. 1, 2, and 3. Accordingly, mounting system 180 includes first member 30 and third member 34 (not shown in FIG. 4). Mounting system 10 also includes a pair of bracket assemblies 182, a second member 184, and a fourth member (not shown). Bracket assemblies 182 are also known as coupling assemblies or tee brackets. In the exemplary embodiment, second member 184 and the fourth member are identical.

Bracket assemblies 182 are coupled to first and third member ends 58 and 68 (not shown in FIG. 4), respectively. Each bracket assembly 182 includes a first body portion 186 and a second body portion 188. First body portion 186 is hollow and includes a bore (not shown) extending therethrough and having a cross sectional profile that is substantially similar to that of first and third member ends 58 and 68. More specifically, the first body portion bore is sized to receive first and third member ends 58 and 68 therethrough in slidable contact. A T-bolt 189 is used to secure bracket assembly first body portion 186 to each respective first and third mounting system member 30 and 34. In an alternative embodiment, neither the fourth member nor third member 184 include openings 174, but rather coupling assemblies 182 are also used to couple the fourth member and third member 184 to rod 122. In a further embodiment, neither the second member nor first member 30 include openings 170, but rather coupling assemblies 182 are also used to couple the second member and first member 30 to rod 154.

Each bracket assembly second body portion 188 is hollow and is rotabaly coupled to bracket assembly first body portion 186. Each second body portion 188 includes a bore (not shown) extending therethrough, which has a cross sectional profile that is substantially similar to that of second member 184 and the fourth member. More specifically, the second body portion bore is sized to receive second member 184 and the fourth member therethrough in slidable contact. A T-bolt 189 is used to secure bracket assembly second body portion 188 to each respective second member 184 and each fourth member. In an alternative embodiment, bracket assembly first body portions 186 are coupled to first rod 120 (shown in FIGS. 2 and 3) rather than to each mounting member 30 and 34.

Second member 184 and the fourth member are substantially similar to second and fourth members 32 and 36 (shown in FIGS. 1, 2, and 3). Accordingly, second member 184 and the fourth member include openings 170 sized to receive suspension mount rod 154. Second member 184 and the fourth member have a length 190 that is longer than length 172 (shown in FIG. 3) of members 32 and 36. More specifically, length 190 is measured between a respective first end 191 of second member 184 and the fourth member, and a second end 192 of second member 184 and the fourth member. Each member second end 192 includes a bumper 194. In one embodiment, bumpers 194 are fabricated from rubber.

In the exemplary embodiment, fastener assemblies 176 are C-clamps. In another embodiment, fastener assemblies 176 are U-bolts. In a further embodiment, fastener assemblies 176 are bracket assemblies (not shown) that are slidably coupled to second member 184 and the fourth member, and include a quick release clamp that is used to secure work platform 12 is secured to mounting system 180.

In operation, the combination of openings 170 and 174 and the hinge action of bracket assemblies 182, permits support system 180 to be adjusted such that first member 30 remains suspended from ladder 14 and is substantially perpendicular to the floor (not shown in FIG. 4) while second member 184 is positioned substantially parallel to the floor. Accordingly, third member 34 would then be positioned substantially perpendicular to the floor while the fourth member is substantially parallel to the floor. As such, when work platform 12 is secured to mounting system 10 with a plurality of fastener assemblies 176, work platform 12 is substantially parallel to the floor. Furthermore, second member length 190 enables second member 182 to be positioned such that bumper 194 is in contact and braced against structure 44 (shown in FIG. 1) to facilitate stabilizing mounting system 180 with respect to ladder 14.

Figure 5:
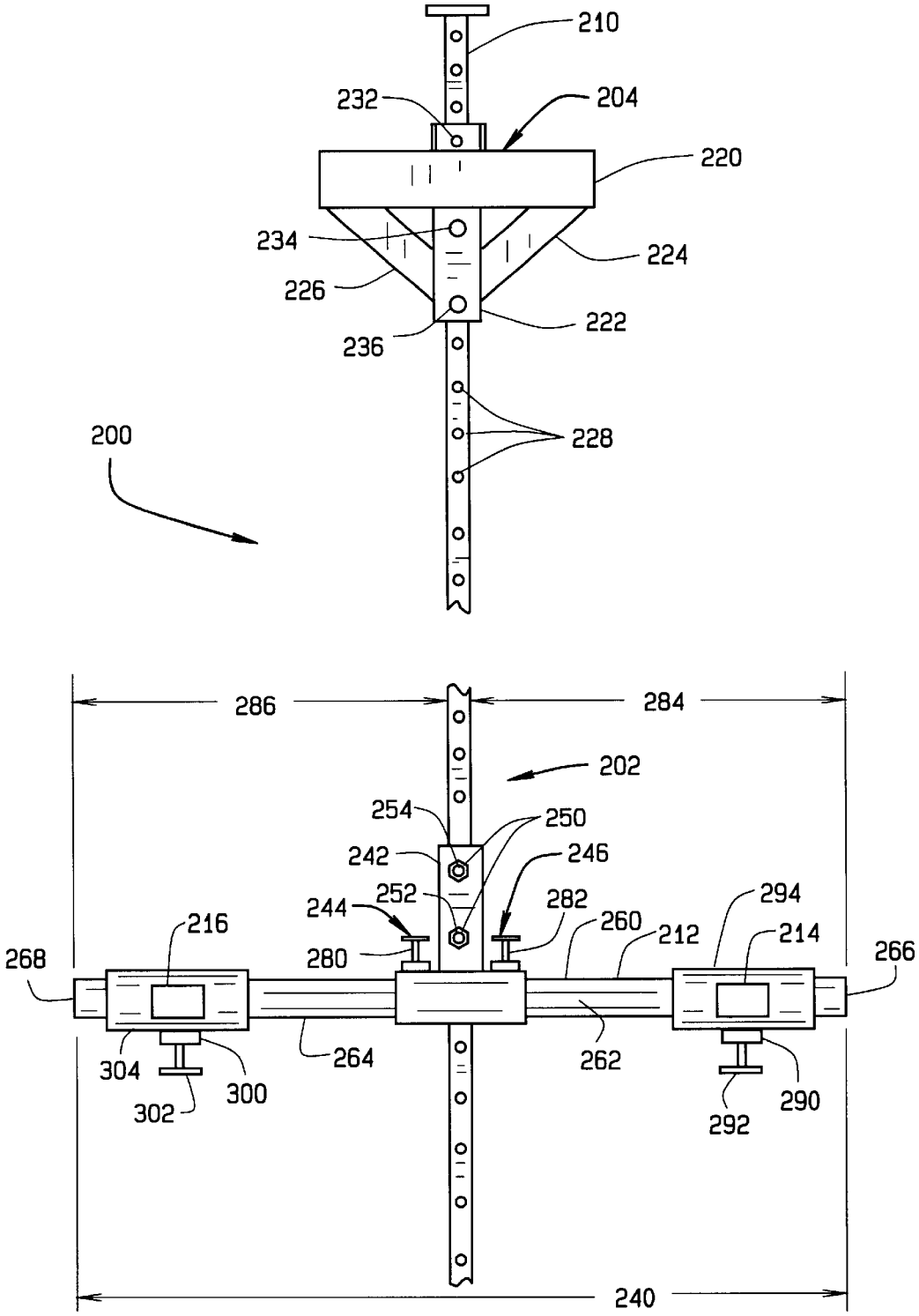
FIG. 5 is a front view of a mounting system for mounting a work platform to a ladder in accordance with a second embodiment of the present invention.

FIG. 5 is a front view of an alternative embodiment of a mounting system 200 for mounting work platform 12 (shown in FIG. 1) to a ladder 14 (shown in FIG. 1). Mounting system 200 includes a support system 202 attached to ladder 14, a rod (not shown in FIG. 4) which extends through a ladder rung 18 (not shown in FIG. 4), and a suspension mount 204 which attaches support system 202 to a ladder rung. Support system 202 includes a first member 210, a second member 212, a third member 214, and a fourth member 216. First member 210 is attached substantially perpendicular to second member 212. Third member 214 and fourth member 216 extend substantially perpendicularly from second member 212. In one embodiment, member 210 has a length (not shown) that enables member 210 to contact the ground to provide additional support to mounting system 200 when mounting system 200 is fully assembled Suspension mount 204 includes a hook assembly 220, a telescoping member 222, a cross brace 224 attached between telescoping member 222 and hook assembly 220, and a cross brace 226 attached between telescoping member 222 and hook assembly 220. In an alternative embodiment, mount 204 does not include cross braces 224 and 226. First member 210 has a rectangular cross-sectional profile and includes a plurality of openings 228. In an alternative embodiment, mounting system members, such as, but not limited to members 210, 212, 214, and 216, have non-rectangular cross-sectional profiles.

Telescoping member 222 has a rectangular cross-sectional profile that is sized slightly larger than the rectangular cross-sectional profile of first member 210. As such, telescoping member 222 includes an inner surface (not shown) that is in slidable contact with an outer surface (not shown) of the rectangular cross-sectional profile of first member 210. Telescoping member 222 includes three locking members 232, 234, and 236 that extend through telescoping member 222 to secure telescoping member 222 to first member 210. Openings 228 are sized and spaced to receive locking members 232, 234, and 236. Hook assembly 220 is sized to fit over and around the ladder rung. More specifically, hook assembly 220 is U-shaped and extends around the ladder rung.

Second member 212 has a length 240 and includes a telescoping member 242, a first bracket 244, and a second bracket 246. Telescoping member 242 has a rectangular cross-sectional profile that is sized larger than the rectangular cross-sectional profile of first member 210. As such, an inner surface (not shown) of the second member telescoping member 242 is in slidable contact with the outer surface (not shown) of the rectangular cross-sectional first member 210. Telescoping member 242 includes a plurality of openings 250 sized to receive a bolt assembly 252. Bolt assembly 252 is inserted through opening 250, opening 228, and first member 210. A nut 254 is attached to bolt assembly 252 to secure telescoping member 242 in position on first member 210. Second member 212 is coupled to telescoping member 242 such that second member 212 is substantially perpendicular to first member 210.

Second member 212 also includes a top surface 260, a front surface 262, a bottom surface 264, and a back surface (not shown) and has a first end 266 and a second end 268. Second member 212 is slidable relative to first member 210 and is anchored in position with bracket assemblies 244 and 246. Bracket assemblies 244 and 246 include T-bolts 280 and 282 respectively that are inserted through bracket assemblies 244 and 246 to contact top surface 260. T-bolts 280 and 282 are tightened against top surface 260 to anchor second member 212 relative to first member 210. Once T-bolts 280 and 282 are tightened, second member 212 has a first length 284 which extends from first member 210 to second member first end 266 and a second length 286 which extends from first member 210 to second member second end 268.

Third member 214 includes bracket assembly 290 which includes T-bolt 292 and telescoping member 294. Telescoping member 294 has a rectangular cross-sectional profile which is larger than the rectangular cross-sectional profile of second member 212. As such, an inner surface (not shown) of telescoping member 294 is in slidable contact with second member top surface 260, front surface 262, bottom surface 264, and the back surface. Third member 214 is welded to telescoping member 294 such that third member 214 extends substantially perpendicularly from second member 212. T-bolts 292 extend through openings (not shown) in telescoping member 294 to contact second member bottom surface 264. Bracket assembly 290 permits third member 214 to be in slidable contact with second member 212 and to be fixedly positioned in any position within second member first length 284.

Fourth member 216 includes bracket assembly 300 which includes T-bolt 302 and telescoping member 304. Telescoping member 304 has a rectangular cross-sectional profile that is larger than the rectangular cross-sectional profile of second member 212. As such, an inner surface (not shown) of telescoping member 304 is in slidable contact with second member top surface 260, front surface 262, bottom surface 264, and the back surface. Fourth member 216 is welded to telescoping member 304 such that fourth member 216 extends substantially perpendicularly from second member 212 T-bolts 302 extend through openings (not shown) in telescoping member 304 to contact second member bottom surface 264. Bracket assembly 300 permits fourth member 216 to be in slidable contact with second member 212 and to be fixedly positioned in any position along second member second length 240. In an alternative embodiment, mounting system 200 uses tee brackets 182 (shown in FIG. 4) for coupling members, such as, but not limited to, members 210, 212, 214, and 216, rather than bracket assemblies 244, 290, or 300.

Figure 6:
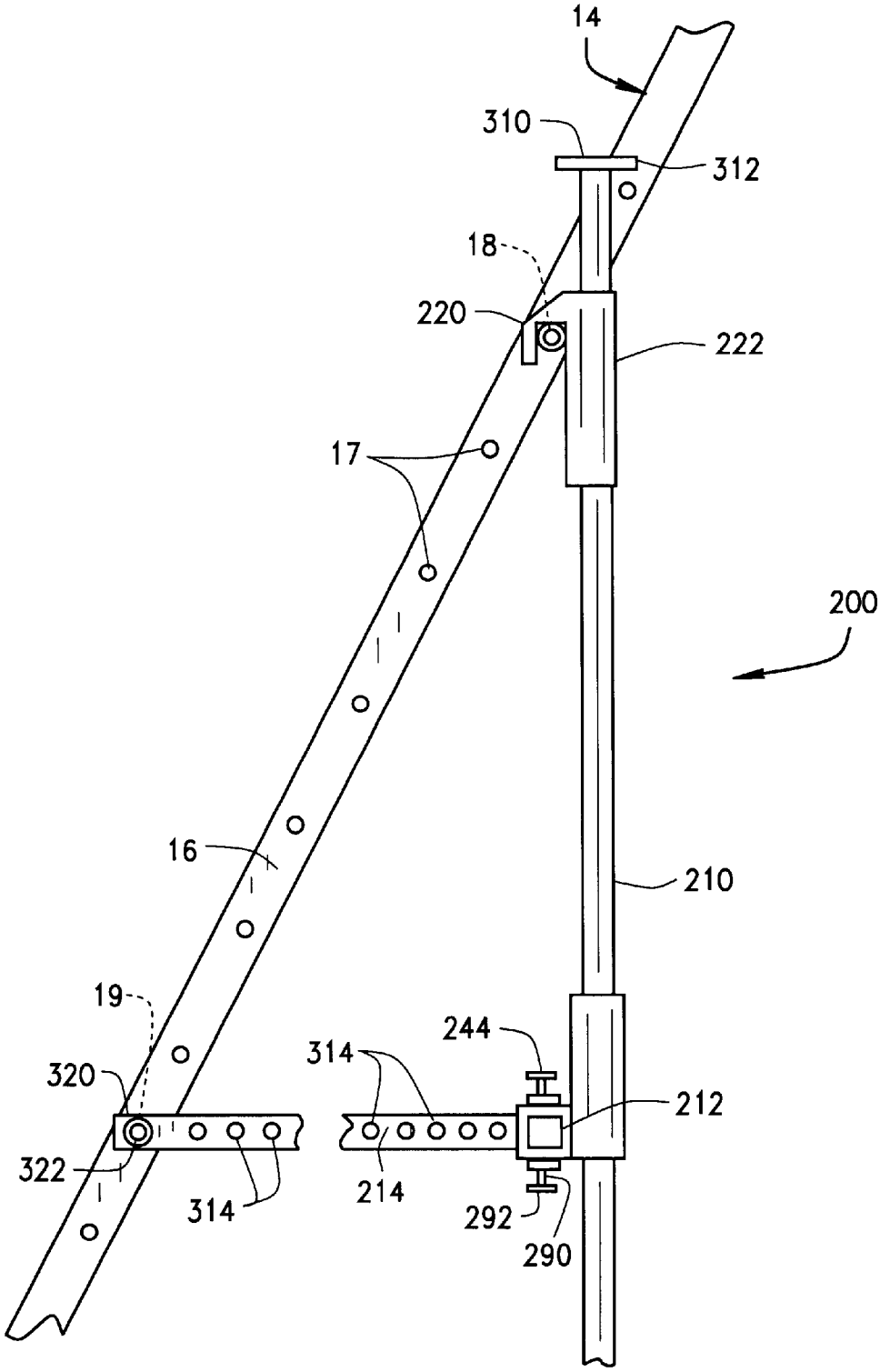
FIG. 6 is a side elevational view of the mounting system shown in FIG. 5 attached to a ladder.

FIG. 6 is a side elevational view of mounting system 200 attached to ladder 14 including rungs 17. First member 210 includes a first end 310 which includes a stop 312 which prevents telescoping member 222 from being repositioned beyond first member first end 310. Telescoping member 222 includes hook assembly 220 that is sized to fit over and around first rung 18. In one embodiment, telescoping member 222 is welded to first member 210 and as such is not adjustable. Third member 214 includes a plurality of openings 314 sized to receive a rod (not shown).

In operation, first member 210 is elevated upward from below ladder 14 between rungs 17 and 18 to permit hook assembly 220 to fit over and around ladder rung 18. Telescoping member 222 is then secured to first member 210 with locking members 233, 234, 236 (shown in FIG. 4) as first member 210 remains suspended from hook assembly 220. Second member 212 is then anchored to first member 210 with bracket 244 and bracket 246 (shown in FIG. 4). Second member 212 is positioned relative to first member 210 such that first member 210 remains suspended substantially perpendicular to the floor (not shown in FIG. 5) and further, such that third member 214 and the fourth member 216 (shown in FIG. 4) can engage ladder 14 and be positioned substantially parallel to the floor. Third member 214 is then positioned to be adjacent ladder upright support 16. Once positioned, third member 214 is anchored to second member 212 with bracket assembly 290 and T-bolt 292. Fourth member 216 is positioned and anchored similarly. A threaded rod (not shown) is inserted through third member 214, second rung 19, and fourth member 216. The rod has a length that permits a washer 320 to be inserted over each end of the rod and positioned against third member 214 and fourth member 216 respectively when the rod is fully inserted. A nut 322 is tightened on each end of the rod against each washer 320 to complete securing mounting system 200 to ladder 14. In another embodiment, members 214 and 216 do not include any openings 314, and rather, a tee-coupling (not shown in FIG. 6) is coupled to the rod, and third and fourth members 214 and 216, respectively, are extended through a portion of the tee fitting to be coupled to ladder 14. In a further embodiment, a pair of extension legs (not shown) are coupled to third and fourth members 214 and 216, respectively, that extend to contact the ground, thus providing additional support and bracing for mounting system 200. Furthermore, in such an embodiment, additional lateral braces may be secured to ladder 14 in a similar manner as described above for members 214 and 216 and coupled to the pair of extension legs to facilitate additional bracing for system 200.

Figure 7:
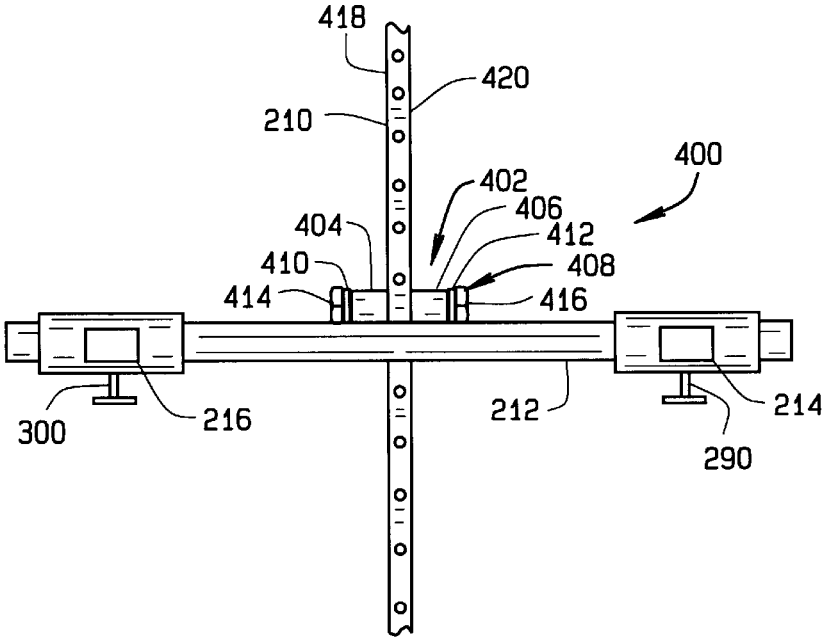
FIG. 7 is a partial enlarged front view of a mounting system for mounting a work platform to a ladder in accordance with a third embodiment of the present invention.

FIG. 7 is a partial front view of a third embodiment of a mounting system 400 for mounting a work platform (not shown in FIG. 6) to a ladder (not shown in FIG. 6). Mounting system 400 includes first member 210, second member 212, third member 214, and fourth member 216. Mounting system 400 also includes bracket assemblies 290 and 300 which anchor third member 214 and fourth member 216 to second member 212 respectively.

Second member 212 is welded to a hinge assembly 402 which includes a first pipe 404, a second pipe 406 and a pin assembly 408. Pin assembly 408 includes a pair of washers 410 and 412, a pair of nuts 414 and 416, and a threaded rod (not shown). First member 210 includes a plurality of openings (not shown) positioned on each sidewall 418 and 420 of first member 210. The openings are sized to receive the threaded rod.

In operation, the rod is inserted through pipe 404, the openings within first member 210, and through first member 210 and pipe 406. Pipe 406 and pipe 404 are positioned adjacent first member 210. Washers 410 and 412 are installed on each end of the threaded rod. Nuts 414 and 416 are installed on each respective end of the threaded rod and tightened against each respective washer 410 and 412. Hinge assembly 402 permits second member 212 to rotate with respect to first member 210. As such, third member 214 and fourth member 216 are rotated simultaneously.

Figure 8:
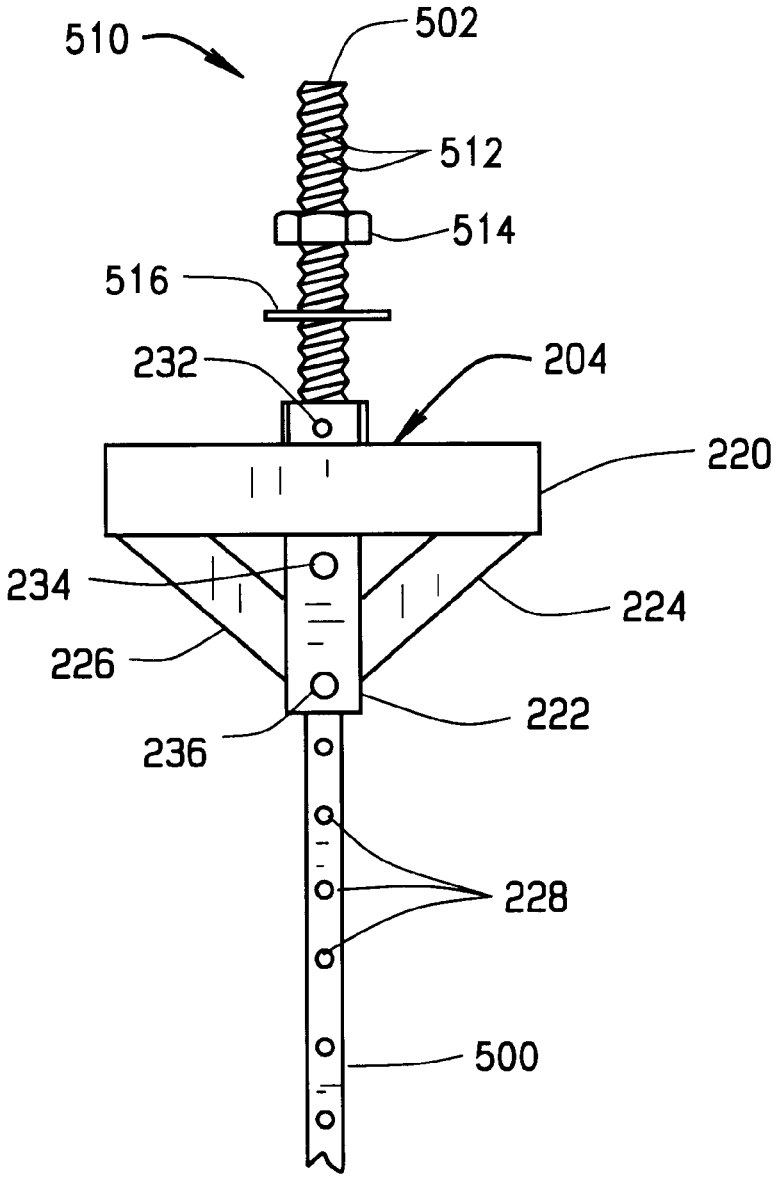
FIG. 8 is an alternative embodiment of a support member that may be used with the mounting system shown in FIG. 5.

FIG. 8 is an alternative embodiment of a support member 500 that may be used with mounting system 200 (shown in FIGS. 5 and 6) or with mounting system 400 (shown in FIG. 7). Member 500 is substantially similar to first member 210 shown in FIGS. 5, 6, and 7 and components of member 500 that are identical to components of member 210 are identified in FIG. 8 using the same reference numerals used in FIGS. 5, 6, and 7. Accordingly, first member 500 is attached substantially perpendicular to second member 212 (shown in FIGS. 5, 6, and 7). Furthermore, in the exemplary embodiment, member 500 has a rectangular cross-sectional profile and includes openings 228. Member 500 also includes an upper end 502 and a lower end (not shown). In one embodiment, member 500 has a length (not shown) that is long enough to enable member 500 to contact the ground to provide additional support to the associated fully-assembled mounting assembly.

Member 500 also includes a threaded portion 510 that extends through hook assembly 220. More specifically, threaded portion 510 extends from member upper end 502 and includes a plurality of threads 512 that enable a nut 514 and washer 516 to secure hook assembly 220 to a ladder rung (not shown in FIG. 8). More specifically, after hook assembly 220 is coupled to a ladder rung, nut 514 is tightened to firmly secure hook assembly 220 to the rung. Additionally, threaded portion 510 may be used to finely adjust a relative position of second member 212 to facilitate leveling work platform 10.

Figure 9:
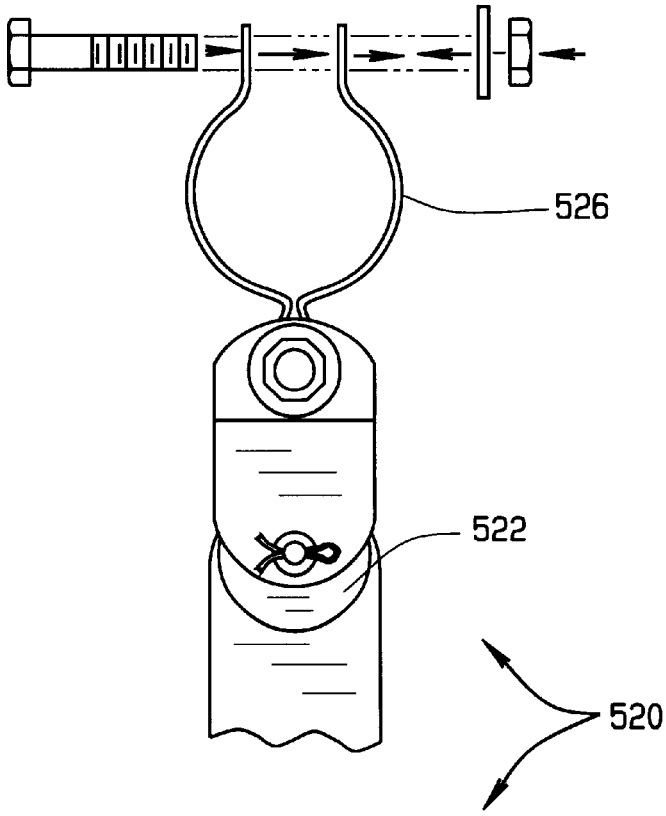
FIG. 9 is an enlarged exemplary embodiment of a pulley and winch system that may be used with the above illustrated mounting assemblies.
Figure 9:
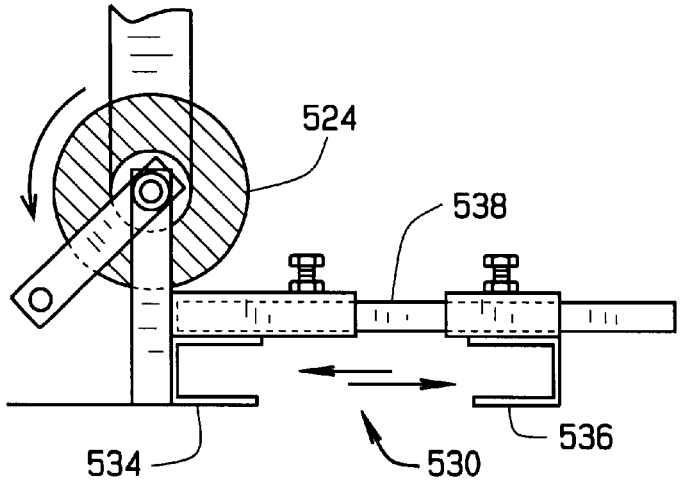

FIG. 9 is an enlarged exemplary embodiment of a pulley and winch system 520 that may be used to facilitate assembling a mounting system, such as, but not limited to, mounting system 200 (shown in FIG. 5), or mounting system 400 (shown in FIG. 7). More specifically, system 520 includes a pulley 522 and a winch 524. Pulley 522 includes a mounting bracket 526 that enables pulley 522 to be secured and suspended from a ladder rung. In one embodiment, pulley 522 is a double pulley.

Winch 524 includes a mounting assembly 530 that enables winch 524 to be secured between a pair of adjacent ladder rungs (not shown in FIG. 9). In an alternative embodiment, mounting assembly 530 enables winch 524 to be secured across a ladder and is secured to the ladder upright supports. In the exemplary embodiment, winch 524 is manually operated and includes a handle crank (not shown in FIG. 9). Alternatively, winch 524 is a powered winch. Mounting assembly 530 includes an upper bracket 534 and a lower bracket 536. Brackets 534 and 536 are slidably coupled to an extension member 538.

In use, pulley 522 is attached to an upper ladder rung with mounting bracket 526. More specifically, in one embodiment, pulley 522 is attached to a ladder prior to the ladder being leaned against the structure. Winch 524 is then attached to either the lowest ladder rung, or in close proximity to the lowest ladder rung. Pulley 522 and winch 524 are then rigged and coupled to a mounting system or working platform to be installed. More specifically, pulley and winch system 520 may be rigged with, but is not limited to, cables, wires, ropes, chains, or flexible strapping.

Figure 10:
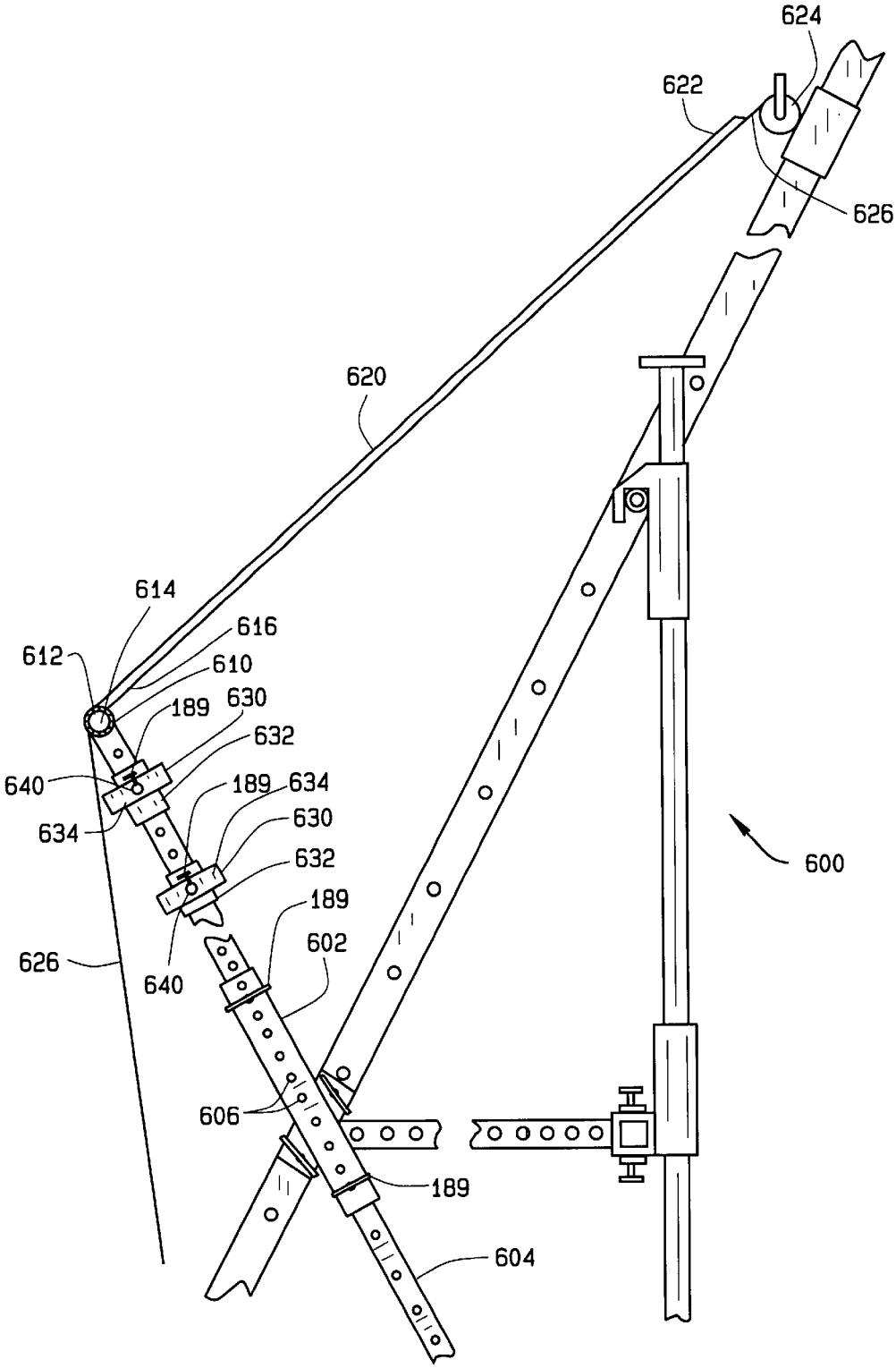
FIG. 10 is a side elevational view of a tarp and handrail system that may be used with the above illustrated mounting assemblies.

FIG. 10 is a side elevational view of an exemplary tarp and handrail system 600 that may be used with a mounting system, such as mounting system 200 shown in FIG. 5, or mounting system 400 shown in FIG. 7. Furthermore, system 600 may be modified for use with system 10 shown in FIG. 1. Tarp and handrail system 600 includes a support member 602 and a telescoping member 604. Support member 602 is rotatably coupled to a work platform support member, such as, but not limited to, members 214 or 216 (shown in FIGS. 5, 6, and 7). Support member 602 is hollow and includes a plurality of openings 606 extending along its length.

Openings 606 enable support member 602 to secure telescoping member 604 in position relative to support member 602. More specifically, support member 602 has a bore (not shown) extending lengthwise therethrough, and having a cross-sectional profile that is substantially similar to that of telescoping member 604. The support member bore is sized to receive telescoping member 604 therethrough. In one embodiment, a plurality of T-bolts 189 are fastened against telescoping member 604 through openings 606 to secure telescoping member 604 in position relative to support member 604. In another embodiment, telescoping member 604 includes a plurality of openings (not shown) that extend lengthwise to enable telescoping member 604 to be secured in position relative to support member 604. In a further embodiment, neither member 602 nor 604 include openings 606, but rather bracket assemblies 189 include tension screws used to secure member 604 in position.

Telescoping member 604 includes a first end 610 including an opening 612. In one embodiment, opening 612 is formed by a tee fitting coupled to member 604. Opening 612 is sized to receive a lateral support brace 614 therethrough. More specifically, lateral support brace 614 extends between adjacent telescoping members 604 and provides an outer surface to which an outer edge 616 of a tarp or wind breaker 620 is secured against. Tarp 620 also includes an inner edge 622 that is secured to a cranking device 624. Tarp 620 facilitates shielding a user on work platform 12 from exposure to weather including, but not limited to, excessive sunlight, precipitation, or wind. Cranking device 624 is attached to a ladder rung and is rigged to tarp inner edge 622 with a tie-down 626. Tie-down 626 extends through tarp 616 and is routed over brace 614 and secured to a ladder rung such that tarp 620 is positioned against lateral brace 614. Cranking device 624 is then wound until tarp 620 is secured to the ladder with a desired tautness.

Telescoping member 604 also includes a plurality of tee-brackets 630. Each tee-bracket 630 includes a first body portion 632 and a second body portion 634. First body portion 632 is hollow and includes a bore (not shown) extending therethrough and having a cross sectional profile that is substantially similar to that of telescoping member 604. More specifically, the first body portion bore is sized to receive telescoping member 604 therethrough in slidable contact. A T-bolt 189 is used to secure bracket assembly first body portion 634 in position relative to telescoping member 604.

Each tee-bracket assembly second body portion 634 is hollow and is rotabaly coupled to tee-bracket assembly first body portion 632. Each second body portion 634 includes a bore 636 that is sized to receive a handrail 640 therethrough. A T-bolt 189 is used to secure each bracket assembly second body portion 634 to each respective handrail 640. Handrails 640 extend between adjacent telescoping members 604 to provide guardrails that are adjacent work platform 10. In an alternative embodiment, tarp and handrail system 600 is installed without tee-rackets 630 and handrails 640 being installed. In a further embodiment, tarp and handrail system 600 is installed without tarp 620 and tie-down 626 is used to provide stability to handrail system 600.

In one embodiment, work platform 10 is an aluminum pick and a pair of rods (not shown) inserted lengthwise through the pick are coupled to members 214 and 216 with additional tee-bracket assemblies.

Figure 11:
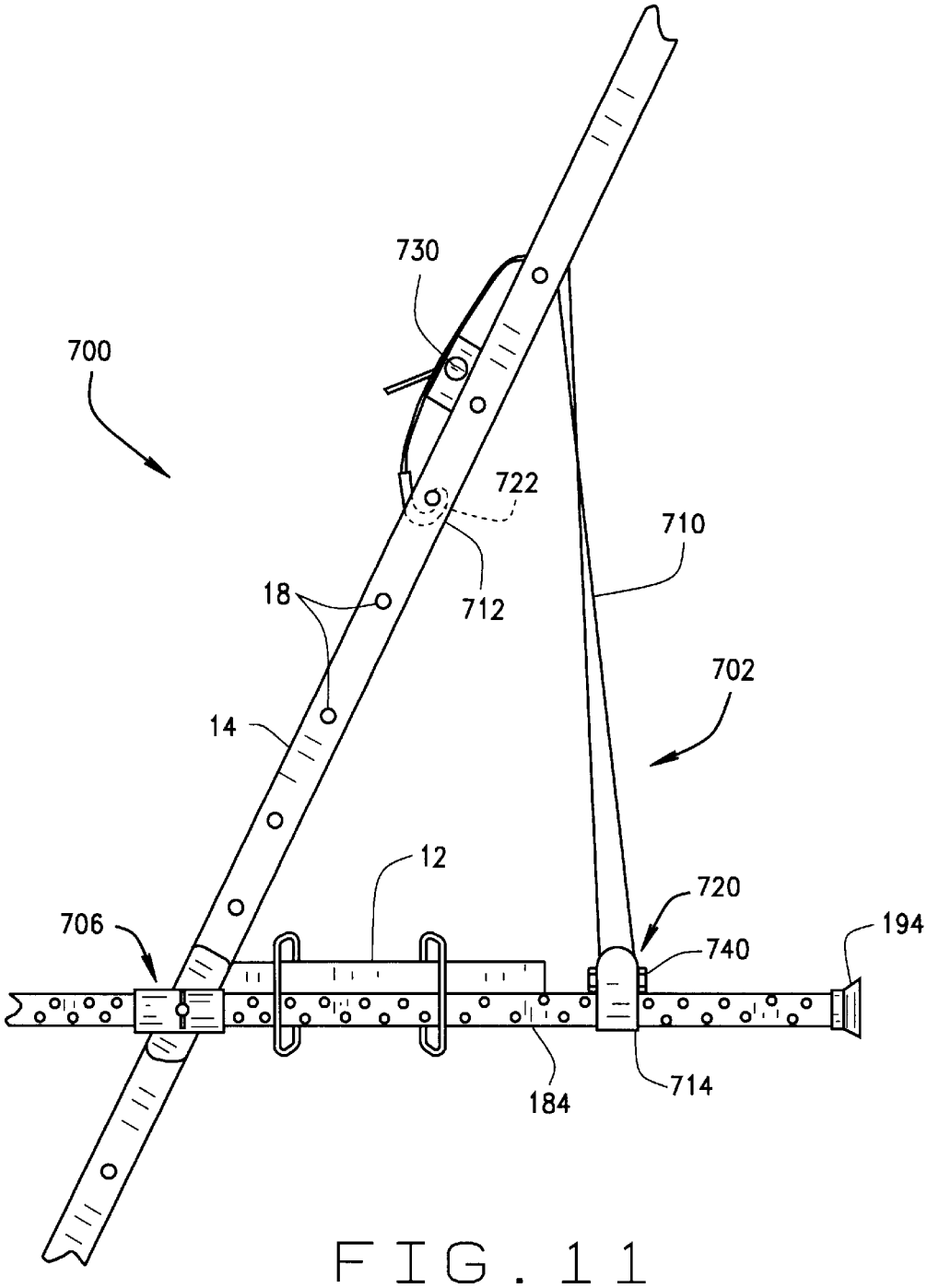
FIG. 11 is a side elevational view of a mounting system for mounting a work platform to a ladder in accordance with a fourth embodiment of the present invention.

FIG. 11 is a side elevational view of a mounting system 700 for mounting a work platform 12 (shown in FIG. 1) to a ladder 14 (shown in FIG. 1). Mounting system 700 is similar to mounting system 180 (shown in FIG. 4) and components in mounting system 700 that are identical to components of mounting system 180 are identified in FIG. 11 using the same reference numerals used in FIG. 4. Accordingly, mounting system 700 includes a support system 702 that includes second member 184 and an identical fourth member (not shown) that include bumpers 194. Second member 184 and the fourth member are substantially similar to second and fourth members 32 and 36 (shown in FIGS. 1, 2, and 3), and each is attached to the ladder as described above.

Mounting system 700 also includes a suspension mount 706 which attaches support system 702 to a ladder rung. In the exemplary embodiment, suspension mount 706 includes a pair of members 710. In an alternative embodiment, suspension mount 706 includes more than two members 710. In a further embodiment, suspension mount 706 includes only one member 710. Each member 710 includes a first end 712 and a second end 714. In the exemplary embodiment, members 710 are cargo straps. In alternative embodiments, members 710 may be, but are not limited to, fabric straps, chain, metallic straps, nylon webbing, cable, rope, or any other suitable product that satisfies the operating parameters as set forth herein.

Member first ends 712 are coupled to respective second member 184 and to the fourth member. Member second ends 714 are coupled to a ladder rung 18. In the exemplary embodiment, member first ends 712 include a loop 720 through which the respective fourth member and second member 184 extend therethrough, and member second ends 714 include a hook mechanism 722. Members 710 also include a known ratcheting mechanism 730 that is activated to facilitate substantially eliminating slack between member first and second ends 712 and 714, respectively, when member 710 is installed. More specifically, ratcheting mechanism 730 facilitates tightening members 710 to a desired tautness which reduces sway of work platform 12. Furthermore, in the exemplary embodiment, members 710 are fully adjustable and positionable along their length between first and second ends 712 and 714. In the exemplary embodiment, member second ends 714 are attached to a ladder rung 18 after member 710 has been wrapped over a second ladder rung 18 that is above the rung to which ends 714 are attached. In another embodiment, a rod, such as rod 120 or 122, shown in FIG. 2, is secured through a ladder rung 18, and member second ends 714 are attached to the rod. In a further embodiment, member second ends 714 are not wrapped over a second ladder rung 18.

Support system 702 also includes a spreader bar 740 that extends between second member 184 and the fourth member to facilitate maintaining a predetermined distance between second member 184 and the fourth member. In a further embodiment, a strap is extended between member 184 and a lower ladder rung to facilitate preventing member 184 inadvertently moved.

Exemplary embodiments of mounting systems are described above in detail. The systems are not limited to the specific embodiments described herein, but rather, components of each system may be utilized independently and separately from other components described herein. Each mounting system component can also be used in combination with other mounting system components.

The above described mounting systems for mounting a work platform to a ladder are cost-effective and highly reliable. The mounting systems include a support system and a rod, which, in combination with a suspension mount reliably positions the mounting systems to attach a work platform. Furthermore, the mounting systems use adjustable equipment that is inexpensive and reliable when compared to other types of elevated work platform systems currently in use. As such, a cost effective and reliable mounting system for mounting a work platform to a ladder is provided.

While the invention has been described in terms of various specific embodiments, those skilled in the art will recognize that the invention can be practiced with modification within the spirit and scope of the claims.

What is claimed is:

1. A mounting system for a ladder including a plurality of rungs, said mounting system comprising:

a work platform;

a support system comprising a plurality of substantially linear members, said members comprising at least a first member, a pair of spaced substantially parallel second member and a third member said first member mounted substantially perpendicularly to said second members and comprising a first end and a said second end, said first member first and second ends comprising a plurality of first openings extending therethrough, said second members for attaching to said work platform such that said work platform is secured against said second members said second member comprising a first end and a second end, said second member first and second ends comprising a plurality of first openings extending therethrough, said support system for attaching to the ladder;

a rod configured to secure said support system to the ladder, said rod further configured to extend through one of the rungs; and a suspension mount attached to said support system, said suspension mount comprising at least one hook assembly coupled to said first member first end, said hook assembly configured to engage at least one ladder rung.

2. A mounting system in accordance with claim 1 wherein said second members each comprises a bumper configured to facilitate bracing said mounting system, each of said second member has a substantially rectangular cross-sectional profile.

3. A mounting system in accordance with claim 1 wherein said first member extends from said work platform to contact the ground to facilitate bracing said mounting system.

4. A mounting system in accordance with claim 1 further comprising a pulley and winch system for attaching to the ladder for raising and lowering at least one of said support system, said suspension mount, and said work platform during assembly of said mounting system.

5. A mounting system in accordance with claim 1 wherein said suspension mount further comprises at least one locking member configured to secure said hook assembly to the at least one rung.

6. A mounting system in accordance with claim 1 further comprising a pulley and winch system configured to attach to the ladder for raising and lowering at least one of said work platform during assembly of said mounting system.

7. A mounting system in accordance with claim 1 wherein said suspension mount comprises a threaded rod and at least one nut, said threaded rod configured to extend through one of the rungs and through said support system.

* * * * *